US012727722B2

(12) United States Patent
Lin et al.

(10) Patent No.: US 12,727,722 B2
(45) Date of Patent: Sep. 8, 2026

(54) TOWEL HEATING DEVICE

(71) Applicant: Guangzhou Hansong Tuojiang Technology Co., Ltd., Guangzhou (CN)

(72) Inventors: Zhenji Lin, Guangzhou (CN); Yueqing Li, Guangzhou (CN)

(73) Assignee: Guangzhou Hansong Tuojiang Technology Co., Ltd., Guangzhou (CN)

( * ) Notice: Subject to any disclaimer, the term of this patent is extended or adjusted under 35 U.S.C. 154(b) by 0 days.

(21) Appl. No.: 19/337,997

(22) Filed: Sep. 24, 2025

(65) Prior Publication Data

US 2026/0013681 A1 Jan. 15, 2026

Related U.S. Application Data

(63) Continuation-in-part of application No. 30/007,622, filed on Jun. 10, 2025, and a continuation-in-part of application No. 19/216,853, filed on May 23, 2025, and a continuation-in-part of application No. 19/216,795, filed on May 23, 2025, now Pat. No. 12,490,871, and a continuation-in-part of application (Continued)

(30) Foreign Application Priority Data

| | | |
|---|---|---|
| Mar. 7, 2024 | (CN) | 202410260988.9 |
| Mar. 7, 2024 | (CN) | 202420441375.0 |
| Apr. 8, 2025 | (CN) | 202520656668.5 |
| Apr. 25, 2025 | (CN) | 202520812659.0 |
| Apr. 25, 2025 | (CN) | 202520812692.3 |
| May 28, 2025 | (CN) | 202530301693.7 |
| Jun. 30, 2025 | (CN) | 202521361604.9 |

(51) Int. Cl.
*A47K 10/06* (2006.01)
*A47K 10/02* (2006.01)

(52) U.S. Cl.
CPC ..... *A47K 10/06* (2013.01); *A47K 10/025* (2013.01)

(58) Field of Classification Search
CPC ..... A47K 10/00; A47K 10/02; A47K 10/025; A47K 10/04
USPC ..... 219/386
See application file for complete search history.

(56) References Cited

U.S. PATENT DOCUMENTS 5,569,401 A * 10/1996 Gilliland ..... A47K 10/06 219/521
5,904,262 A * 5/1999 Coppi ..... B65D 11/1853 220/666

(Continued)

*Primary Examiner* — Sang Y Paik

(57) ABSTRACT

A towel heating device includes a heating device body. The heating device body defines an accommodation cavity and an opening communicated with the accommodation cavity and includes two body walls, two folding walls, and a heating assembly. The two folding walls are arranged opposite each other. Each of the two folding walls defines a folding groove, each of the two folding walls is configured to fold or unfold along the folding groove of a respective one of the two folding walls and drive the two body walls to move close to or away from each other, and the two body walls and the two folding walls are at least partially made of a hard material. The heating assembly is at least partially arranged on at least one of the two body walls and the two folding walls and is configured to heat the accommodation cavity.

18 Claims, 7 Drawing Sheets

Related U.S. Application Data

No. 19/189,293, filed on Apr. 25, 2025, which is a continuation-in-part of application No. 18/763,734, filed on Jul. 3, 2024, said application No. 19/216,795 is a continuation-in-part of application No. 18/763,734, filed on Jul. 3, 2024, said application No. 19/216,853 is a continuation-in-part of application No. 18/763,632, filed on Jul. 3, 2024, now Pat. No. 12,329,326, said application No. 19/189,293 is a continuation-in-part of application No. 18/763,632, filed on Jul. 3, 2024, now Pat. No. 12,329,326, said application No. 19/216,795 is a continuation-in-part of application No. 18/763,632, filed on Jul. 3, 2024, now Pat. No. 12,329,326, said application No. 19/216,853 is a continuation-in-part of application No. 18/763,734, filed on Jul. 3, 2024.

(56) References Cited

U.S. PATENT DOCUMENTS

| | | | | |
|---|---|---|---|---|
| 7,334,684 | B1 * | 2/2008 | Fontanilla | A45C 13/02 190/110 |
| 2003/0103691 | A1 * | 6/2003 | Adams | A45C 13/02 383/121.1 |
| 2019/0225375 | A1 * | 7/2019 | Sena | A47G 29/20 |

* cited by examiner

TOWEL HEATING DEVICE

CROSS REFERENCE TO RELATED APPLICATIONS

This application is a continuation-in-part of the U.S. patent application Ser. No. 30/007,622, filed on Jun. 10, 2025, a continuation-in-part of the U.S. patent application Ser. No. 19/189,293, filed on Apr. 25, 2025, a continuation-in-part of the U.S. patent application Ser. No. 19/216,795, filed on May 23, 2025, and a continuation-in-part of the U.S. patent application Ser. No. 19/216,853, filed on May 23, 2025. This application claims foreign priorities of the Chinese patent application No. 202410260988.9, filed on Mar. 7, 2024, the Chinese patent application No. 202420441375.0, filed on Mar. 7, 2024, the Chinese patent application No. 202520656668.5, filed on Apr. 8, 2025, the Chinese patent application No. 202520812659.0, filed on Apr. 25, 2025, the Chinese patent application No. 202520812692.3, filed on Apr. 25, 2025, the Chinese patent application No. 202521361604.9, filed on Jun. 30, 2025 and Chinese patent application No. 202530301693.7, filed on May 28, 2025. The disclosure of which is hereby incorporated by reference in their entireties.

The U.S. patent application Ser. No. 30/007,622 claims foreign priorities of the Chinese patent application No. 202530301693.7, filed on May 28, 2025.

The U.S. application Ser. No. 19/189,293 is a continuation-in-part of the U.S. application Ser. No. 18/763,632, filed on Jul. 3, 2024 and a continuation-in-part of the U.S. application Ser. No. 18/763,734, filed on Jul. 3, 2024 and claims foreign priorities of the Chinese patent application No. 202410260988.9, filed on Mar. 7, 2024, the Chinese patent application No. 202420441375.0, filed on Mar. 7, 2024, and the Chinese patent application No. 202520656668.5, filed on Apr. 8, 2025.

The U.S. patent application Ser. No. 19/216,795 is a continuation-in-part of the U.S. application Ser. No. 18/763,632, filed on Jul. 3, 2024 and a continuation-in-part of the U.S. application Ser. No. 18/763,734, filed on Jul. 3, 2024 and claims foreign priorities of the Chinese patent application No. 202410260988.9, filed on Mar. 7, 2024, the Chinese patent application No. 202420441375.0, filed on Mar. 7, 2024, and the Chinese patent application No. 202520812659.0, filed on Apr. 25, 2025.

The U.S. patent application Ser. No. 19/216,853 is a continuation-in-part of the U.S. application Ser. No. 18/763,632, filed on Jul. 3, 2024 and a continuation-in-part of the U.S. application Ser. No. 18/763,734, filed on Jul. 3, 2024 and claims foreign priorities of the Chinese patent application No. 202410260988.9, filed on Mar. 7, 2024, the Chinese patent application No. 202420441375.0, filed on Mar. 7, 2024, and the Chinese patent application No. 202520812692.3, filed on Apr. 25, 2025.

FIELD OF THE DISCLOSURE

The present disclosure relates to the field of household products, particularly to a towel heating device.

BACKGROUND

Towel heating buckets are mainly used to store towels and heat the towels, enabling quick heating of the towels to a suitable temperature, so that people can enjoy a more comfortable towel temperature after bathing or washing their faces. Currently, a bucket body of the towel heating buckets is generally of a fixed structure, occupying a large space and unable to deform, making the towel heating buckets inconvenient to carry and store.

Therefore, it is necessary to improve existing towel heating buckets to avoid the aforementioned drawbacks.

SUMMARY

The following presents a simplified summary of the disclosure in order to provide a basic understanding of some aspects of the disclosure. This summary is not an extensive overview of the disclosure. It is not intended to identify critical elements or to delineate the scope of the disclosure. Its sole purpose is to present some concepts of the disclosure in a simplified form as a prelude to the more detailed description that is presented elsewhere.

In some embodiments, a tie-down anchor is provided. A towel heating device includes a heating device body. The heating device body defines an accommodation cavity and an opening communicated with the accommodation cavity and includes two body walls, two folding walls, and a heating assembly. The two folding walls are arranged opposite each other. Each of the two folding walls defines a folding groove, each of the two folding walls is configured to fold or unfold along the folding groove of a respective one of the two folding walls and drive the two body walls to move close to or away from each other, and the two body walls and the two folding walls are at least partially made of a hard material. The heating assembly is at least partially arranged on at least one of the two body walls and the two folding walls and is configured to heat the accommodation cavity.

BRIEF DESCRIPTION OF THE DRAWINGS

Illustrative embodiments of the present disclosure are described in detail below with reference to the attached drawing figures.

Figure 1:
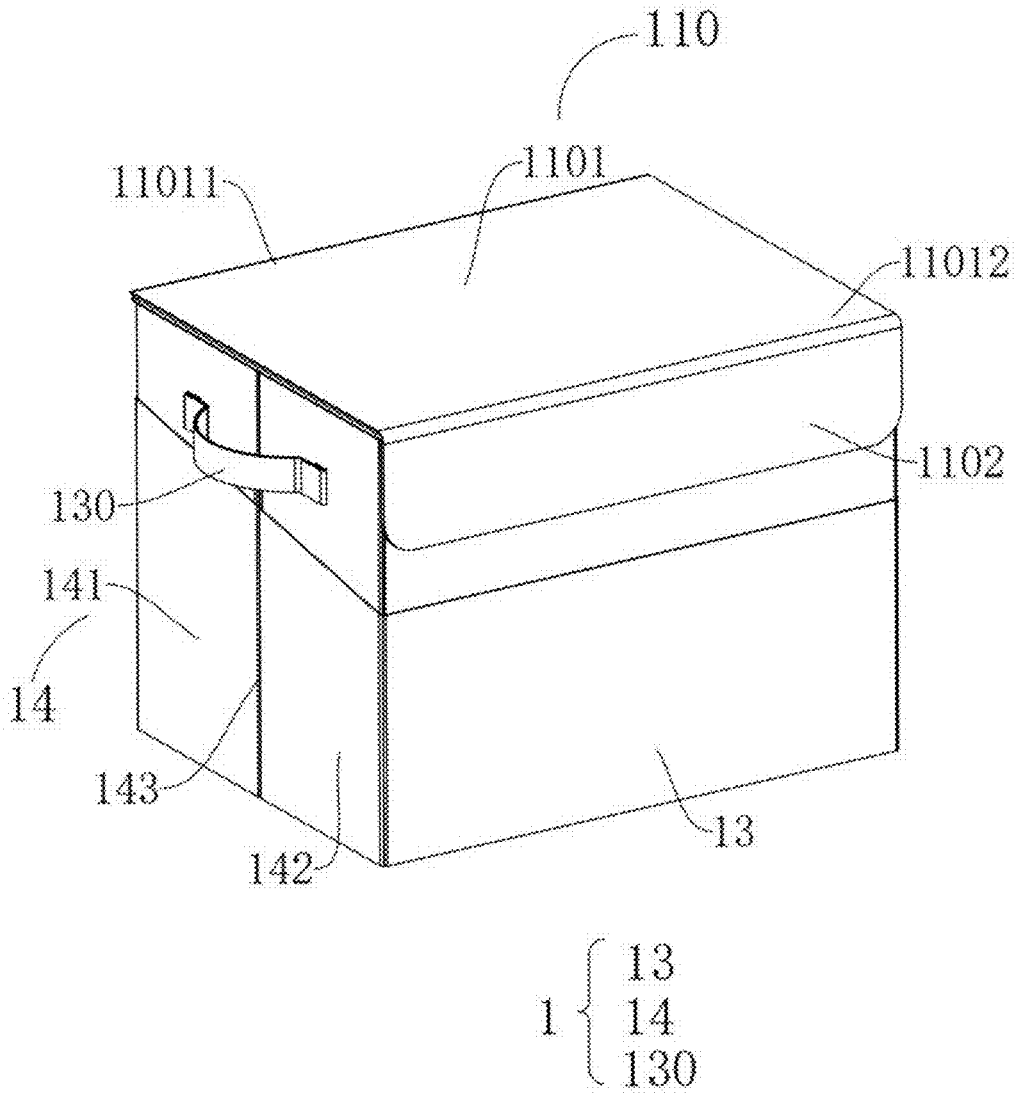
FIG. 1 is a structural view of a towel heating device according to an embodiment of the present disclosure.

Reference numerals in the drawings:

1—heating device body; 11—accommodation cavity; 111—storage space; 12—opening; 13—body wall; 14—folding wall; 141—first connecting wall; 142—second connecting wall; 143—folding groove; 15—bottom wall; 151—support foot; 152—first flexible layer; 153—rigid layer; 154—second flexible layer; 16—first fabric layer; 17—reinforcement plate; 18—thermal insulation layer; 19—second fabric layer; 110—cover; 1101—body portion; 11011—connecting end; 11012—extending end; 1102—extension portion; 120—divider; 1201—first dividing sheet; 1202—second dividing sheet; 130—handle; 140—inner wall of the heating device body;

2—heating assembly; 21—heating wire;

3—wiring member;

4—power controller;

5—shielding layer.

DETAILED DESCRIPTION

The following describes some non-limiting exemplary embodiments of the disclosure with reference to the accompanying drawings. The described embodiments are merely a part rather than all of the embodiments of the disclosure. All other embodiments obtained by a person of ordinary skill in the art based on the embodiments of the disclosure shall fall within the scope of the disclosure.

It should be noted that the terms "first", "second", etc. in the description, claims, and accompanying drawings of the present disclosure are used to distinguish similar objects, and are not necessarily used to describe a specific order or sequence. It should be understood that the data used in this way can be interchanged in appropriate circumstances, so that the embodiments of the present disclosure described herein can be implemented in an order other than those illustrated or described herein.

In the description of the present disclosure, it needs to be explained that unless otherwise clearly specified and limited, the terms "arranged", "mounted", "connected", "coupled" should be understood in a broad sense. For example, it can be a fixed connection, or a detachable connection, or an integrated connection; it can be a mechanical connection; it can be directly connected, or indirectly connected through an intermediate medium, or it can be an internal communication between two components. For those skilled in the art, the specific meaning of the above terms in the present disclosure can be understood in specific situations.

In the description of this specification, reference to terms such as "example", "an example", and "an embodiment" means that specific features, structures, materials, or characteristics described in conjunction with the example or embodiment are included in at least one example or embodiment of the present disclosure. The illustrative descriptions of the above terms in this specification do not necessarily refer to the same example or embodiment. Moreover, the described specific features, structures, materials, or characteristics can be combined in any one or more examples or embodiments in a suitable manner.

The present disclosure will be described in detail below with reference to the accompanying drawings.

Figure 2:
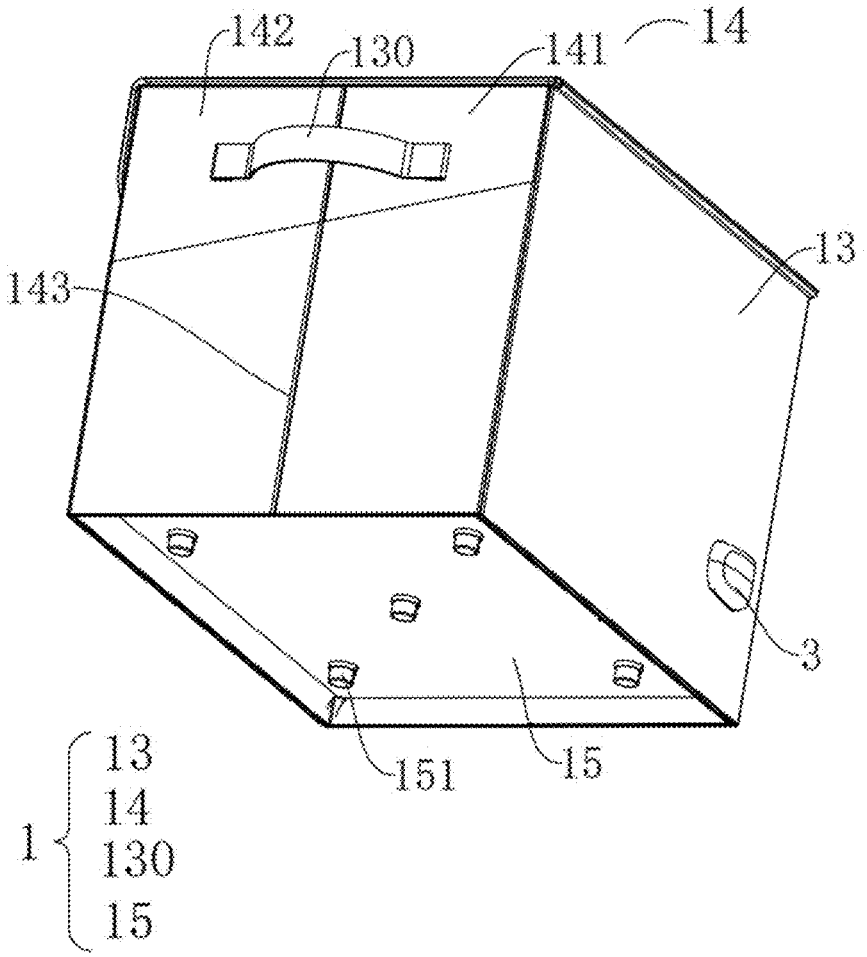
FIG. 2 is a structural view of the towel heating device from another perspective according to an embodiment of the present disclosure.
Figure 4:
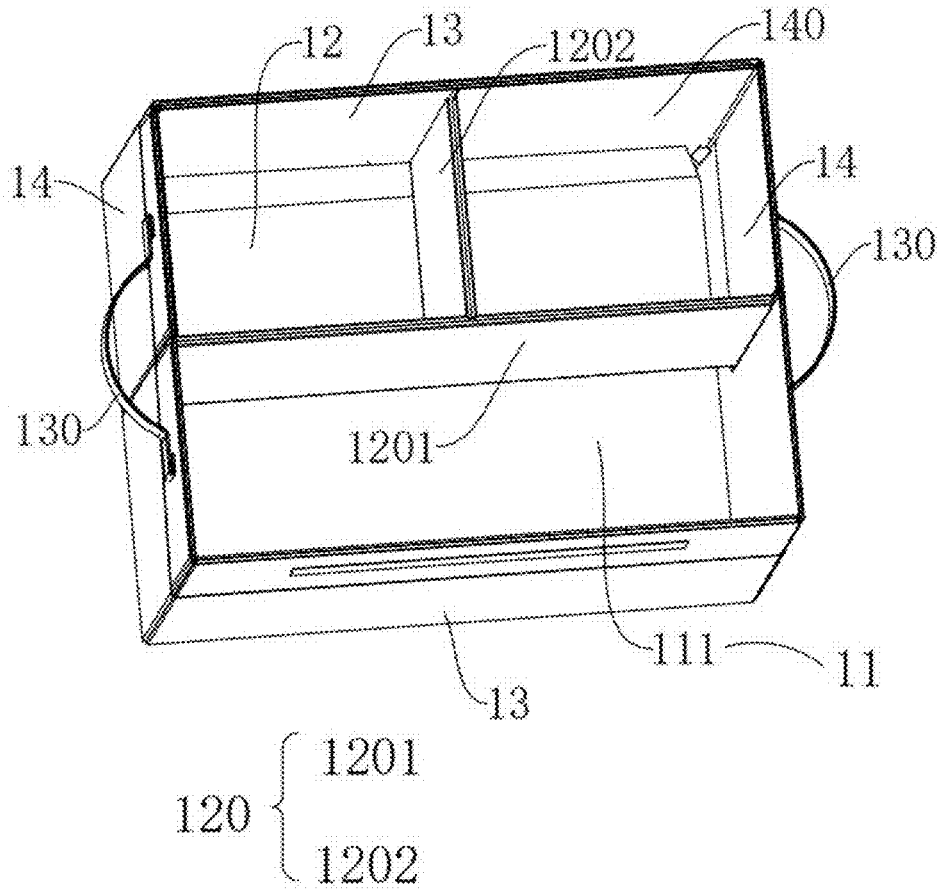
FIG. 4 is a structural view of a heating device body according to an embodiment of the present disclosure.

To solve the above technical problems, as shown in FIGS. 1, 2, and 4, an embodiment of the present disclosure provides a towel heating device. The towel heating device may include a heating device body 1. The heating device body 1 may define an accommodation cavity 11 and an opening 12 communicated to the accommodation cavity 11, allowing users to place or retrieve items such as towels from the accommodation cavity 11 through the opening 12. The heating device body 1 may include two body walls 13 which may be arranged opposite each other and two folding walls 14 which may be arranged opposite each other. The two body walls 13 and the two folding walls 14 may cooperatively form a circumferential side wall of the heating device body 1. Each of the two folding walls 14 may define a folding groove 143. When each folding wall 14 folds inward along a respective folding groove 143, the two body walls 13 may be driven to approach to each other until the heating device body 1 is fully folded. Conversely, when each folding wall 14 unfolds outward along the respective folding groove 143, the two body walls 13 may be driven to move away from each other until the heating device body 1 is fully unfolded. The two body walls 13 and the two folding walls 14 may be at least partially made of a hard material to ensure the heating device body 1 may maintains a shape when unfolded, preventing accidental collapse or deformation due to an external force or an own weight of the heating device body 1. The heating assembly 2 may be at least partially arranged on the body walls 13 and/or the folding walls 14 to heat the accommodation cavity 11. In summary, the towel heating device of the present disclosure may be folded, making the towel heating device convenient for users to carry and store.

As shown in FIGS. 1 and 2, each of the two folding walls 14 may include a first connecting wall 141 and a second connecting wall 142. The first connecting wall 141 may be movably connected to one of the two body walls 13, allowing the first connecting wall 141 to rotate relative to the one of the two body walls 13 when the towel heating device is folded. The second connecting wall 142 may be movably connected to the other of the two body walls 13, allowing the second connecting wall 142 to rotate relative to the other of the two body walls 13 when the heating device body 1 is being folded or unfolded. The first connecting wall 141 and the second connecting wall 142 may operate together to complete a folding action. The above movable connection may be a hinge connection or a flexible connection mentioned bellow, which is not specifically limited here. The folding groove 143 may be vertically formed between the first connecting wall 141 and the second connecting wall 142 and may serve as a folding guide for the folding wall 14. When a user applies force to bring the two body walls 13 closer, the first connecting wall 141 and the second connecting wall 142 may rotate relative to each other along a respective preset folding groove 143, forming a Z-shaped folding effect. The folding groove 143 may ensure a smooth folding process for the heating device body 1.

As shown in FIGS. 1 and 2, the heating device body 1 may further include a bottom wall 15. The bottom wall 15 may be made of a flexible material, specifically flexible fabric. The bottom wall 15 may be connected to a bottom portion of each of the two body walls 13 and the two folding walls 14. The bottom wall 15, the two body walls 13, and the two folding walls 14 may cooperatively define the accommodation cavity 11. When the heating device body 1 is unfolded, the bottom wall 15 may naturally expand to form a stable base. When the heating device body 1 is folded, the bottom wall 15 may be folded accordingly for storage. Additionally, a bottom face of the bottom wall 15 may be arranged with a plurality of support feet 151. When the bottom wall 15 is unfolded, the support feet 151 may contact the ground or other surfaces, working with the bottom wall 15 to bear weight and prevent deformation or collapse.

Figure 6:
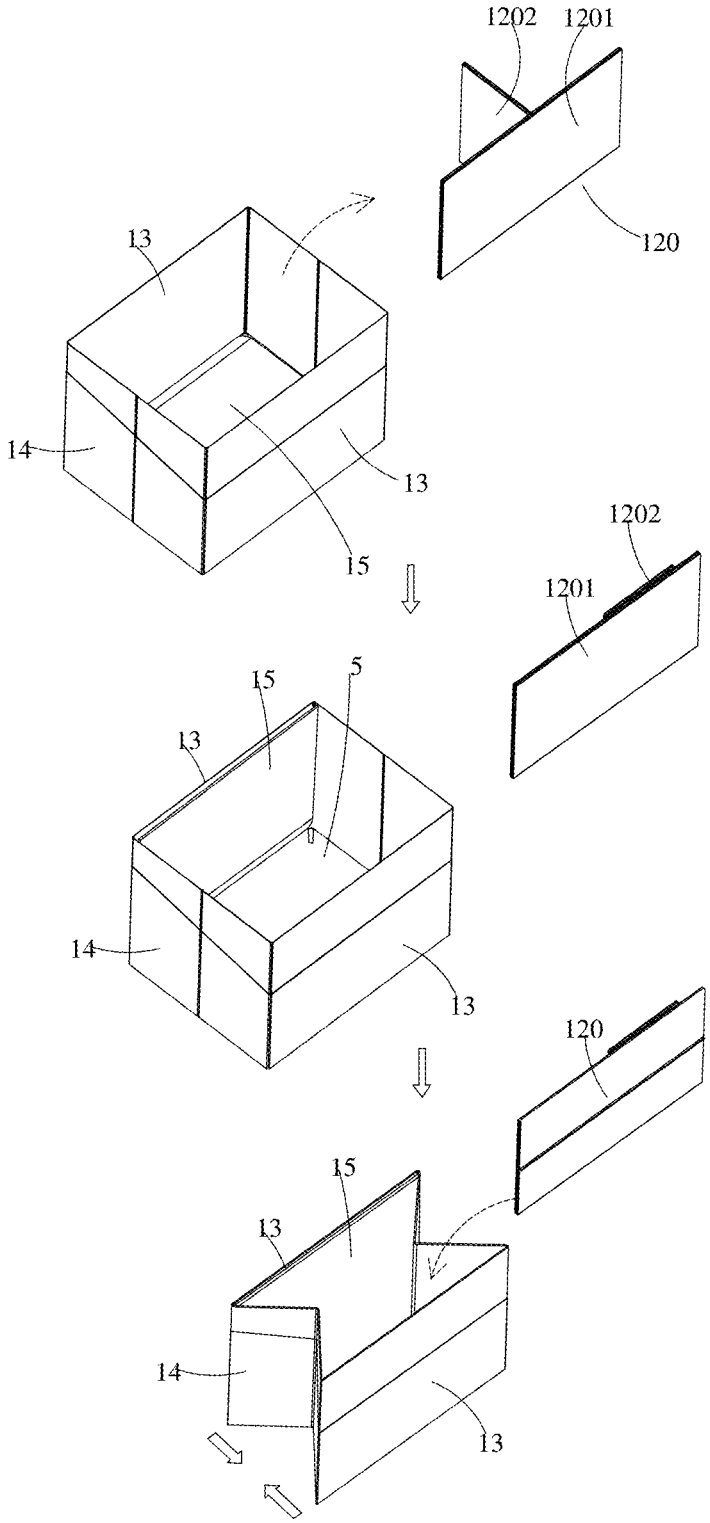
FIG. 6 is a schematic view of a storage process of the towel heating device according to an embodiment of the present disclosure.
Figure 7:
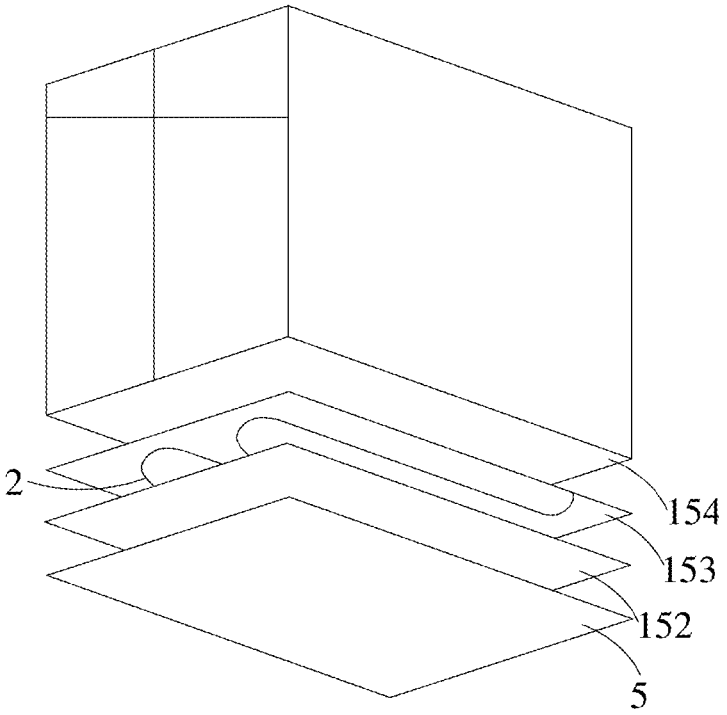
FIG. 7 is a partially exploded view of the towel heating device according to an embodiment of the present disclosure.

Furthermore, as shown in FIGS. 6 and 7, the bottom wall 15 may be movably connected to one of the two body walls 13. Each of the two folding walls 14 and the other of the two body walls 13 may be detachably connected to the bottom wall 15. Specifically, the bottom wall 15 may include a first flexible layer 152, a rigid layer 153, and a second flexible layer 154 which may be arranged from an exterior of the towel heating device to an interior of the towel heating device. A side of each of the first flexible layer 152 and the second flexible layer 154 may be movably connected to one of the two body walls 13, and other sides of each of the first flexible layer 152 and the second flexible layer 154 may be detachably connected to each of the two folding walls 14 and the other of the two body walls 13. Specifically, each of the first flexible layer 152 and the second flexible layer 154 may be made of a fabric material, and the rigid layer 153 may be a honeycomb board, a detachable connection between the bottom wall 15 and each of the other of the two body walls 13 and the two folding walls 14 may be achieved through means such as a hook-and-loop fastener or a snap fastener. When the towel heating device needs to be stored, detachable connections between the bottom wall 15 and the other of the two body walls 13 as well as the two folding walls 14 may be released first. The bottom wall 15 may then rotated to be folded relative to the one of the two body walls 13 which is movably connected with the bottom wall 15 toward a top portion of the towel heating device until the bottom wall 15 lies flat against the connected body wall 13. After the towel heating device is folded, the bottom wall 15 may be located between the two body walls 13, or on a side of the one of the two body walls 13 which is movably connected with the bottom wall 15 facing away from the other of the two body walls 13.

In one embodiment, the bottom wall 15 may heat the accommodation cavity 11. Specifically, a portion of the heating assembly 2 may be arranged on the bottom wall 15, particularly on the rigid layer 153 and between the first flexible layer 152 and the second flexible layer 154, thereby providing the bottom wall 15 with a heating function. In other embodiments, the bottom wall 15 may also be arranged with a heating mechanism independent of the heating assembly 2.

In one embodiment, as shown in FIGS. 6-7, the towel heating device may further include a shielding layer 5. The shielding layer 5 may be arranged at a bottom end of the heating device body 1, specifically on a side of the bottom wall 15 away from the accommodation cavity 11, thereby providing a shield for the bottom wall 15. The shielding layer 5 may be connected to bottom edges of the two body walls 13 and the two folding walls 14. Furthermore, the shielding layer 5 may be made of a flexible material, such as flexible fabric, so as not to affect folding of the heating device body 1.

Figure 3:
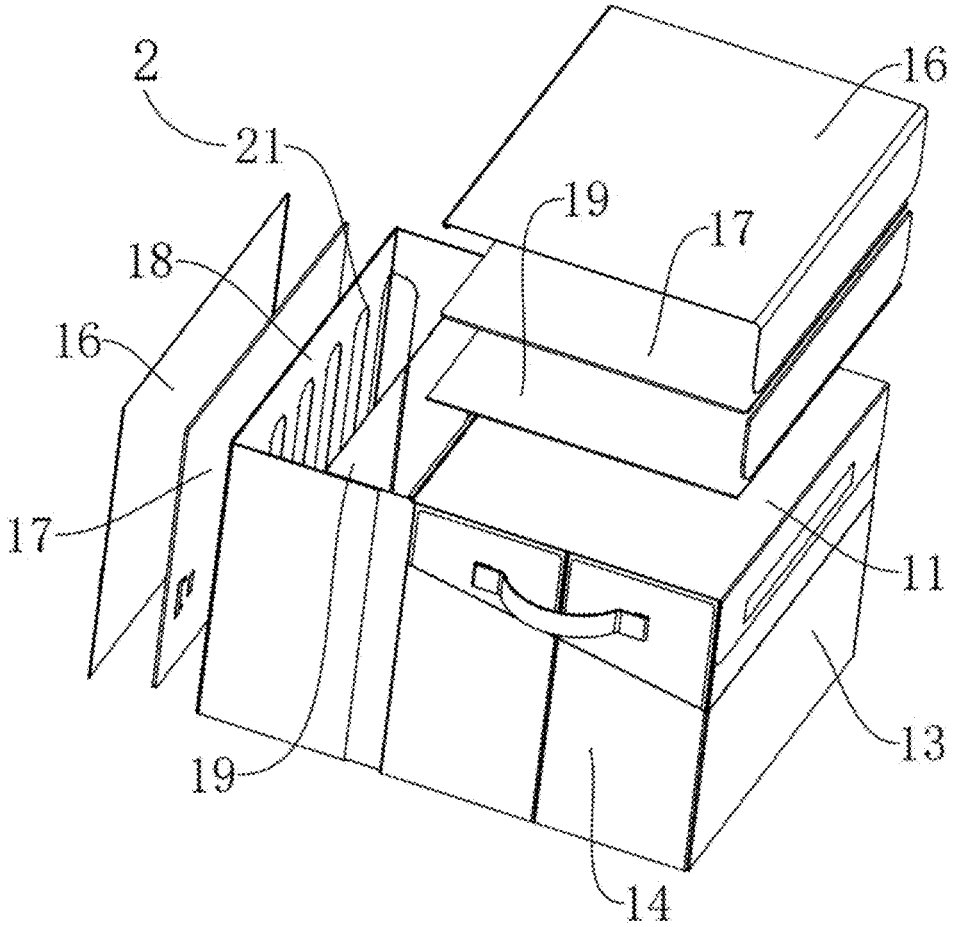
FIG. 3 is a partially exploded view of the towel heating device according to an embodiment of the present disclosure.

In one embodiment of the present disclosure, as shown in FIG. 3, each of the two folding walls 14 and the two body walls 13 may include a first fabric layer 16, a reinforcement plate 17, a thermal insulation layer 18, and a second fabric layer 19 which are arranged from an exterior of the towel heating device to an interior of the towel heating device. Specifically, each of the first connecting wall 141 and the second connecting wall 142 may include, in sequence, the first fabric layer 16, the reinforcement plate 17, the thermal insulation layer 18, and the second fabric layer 19. Each of the first fabric layer 16 and the second fabric layer 19 may be flexible. The reinforcement plate 17 may be made of a hard material, such as wood, plastic, aluminum alloy sheet, or a high-strength composite material, and may be correspondingly arranged along a plane direction of the two folding walls 14 and the two body walls 13. When the towel heating device is unfolded, the reinforcement plate 17 may maintain shape stability of the heating device body 1, preventing towel accumulation or uneven heating due to deformation of the flexible fabric layers. During folding, the reinforcement plate 17 may prevent an excessive deformation of the first fabric layer 16 and the second fabric layer 19, facilitating a folding of the heating device body 1. The reinforcement plate 17, combined with the first fabric layer 16 and the second fabric layer 19, may meet flexibility requirements for folding while ensuring structural reliability when unfolded.

As shown in FIGS. 1, 2, and 3, each first connecting wall 141 and a respective one of the two body walls 13 may be flexibly connected to each other through at least one of the first fabric layer 16 and the second fabric layer 19. That is, at least one of the first fabric layer 16 and the second fabric layer 19 of the each first connecting wall 141 and the at least one of the first fabric layer 16 and the second fabric layer 19 of the respective one of two body walls 13 may be integrally formed as a one-piece structure or stitched together, allowing each body wall 13 and the respective one of the two first connecting walls 141 to rotate freely in a certain angle due to extensibility and elasticity of the first fabric layer 16 and/or the second fabric layer 19. Similarly, each second connecting wall 142 and the other of the two body walls 13 may be flexibly connected to each other through at least one of the first fabric layer 16 and the second fabric layer 19. Each first connecting wall 141 and a respective second connecting wall 142 may be flexibly connected to each other through at least one of the first fabric layer 16 and the second fabric layer 19 to form a respective folding groove 143. During folding, the first fabric layer 16 and/or the second fabric layer 19 may first wrinkle and deform, driving each first connecting wall 141 and the respective second connecting wall 142 to fold inward along the respective folding groove 143 until the folding is complete.

As shown in FIG. 3, the heating assembly 2 may be a heating wire 21, and the thermal insulation layer 18 may be a heating cotton layer. The heating wire 21 may be arranged in the thermal insulation layer 18 in a woven manner. Specifically, the heating wire 21 may be arranged in an S-shape along a thickness direction of the thermal insulation layer 18 and arranged in parallel at certain intervals horizontally, forming a crisscross three-dimensional heating matrix.

In one embodiment of the present disclosure, as shown in FIG. 1, the towel heating device may further include a cover 110. The cover 110 may include a body portion 1101 and an extension portion 1102. The body portion 1101 may be detachably arranged at the opening 12 of the accommodation cavity 11 to seal and insulate the accommodation cavity 11. The body portion 1101 may include a connecting end 11011 and an extending end 11012. The connecting end 11011 may be movably connected to a top edge of the heating device body 1, which may be achieved through a hinge or a flexible connection mentioned bellow, allowing the cover 110 to open and close for users to place or retrieve items such as towels. The extension portion 1102 may be arranged at the extending end 11012 of the body portion 1101 and may be detachably connected to the heating device body 1 through a structure such as a magnet, buckle, or hook-and-loop fastener, ensuring a tight seal when the cover 110 is closed.

As shown in FIGS. 1 and 3, the cover 110 may at least include the first fabric layer 16, the reinforcement plate 17, and the second fabric layer 19. The body portion 110 may be flexibly connected to the heating device body 1 through at least one of the first fabric layer 16 and the second fabric layer 19. Specifically, the body portion 1101 may be flexibly connected to either of the two body walls 13 of the heating device body 1. The first fabric layer 16 and/or the second fabric layer 19 of the body portion 1101 and the first fabric layer 16 and/or the second fabric layer 19 of the body wall 13 may be integrally formed as a one-piece structure or stitched together, allowing the body portion 1101 to rotate relative to the body wall 13 in a certain angle due to the extensibility and elasticity of the first fabric layer 16 and/or the second fabric layer 19.

In one embodiment of the present disclosure, as shown in FIG. 4, the heating device body 1 may further include a divider 120 which is flexible. The divider 120 may be arranged in the accommodation cavity 11 to partition the accommodation cavity 11 to a plurality of storage spaces 111. The divider 120 may include a first dividing sheet 1201 extending in a length direction of the accommodation cavity 11 across the accommodation cavity 11 and at least one second dividing sheet 1202 extending in a width direction of the accommodation cavity 11 along the accommodation cavity 11. Each of two ends of the first dividing sheet 1201 may be detachably connected to a respective one of the two folding walls 14 through a hook-and-loop fastener or a snap button. At least one second dividing sheet 1202 may be connected between the first dividing sheet 1201 and one of the two body walls 13, partitioning the accommodation cavity 11 to the plurality of storage spaces 111 for users to selectively place different items. When the two folding walls 14 are folded, the first dividing sheet 1201 may be detached from the two folding walls 14, allowing the first dividing sheet 1201 and the second dividing sheet 1202 to attach to the body walls 13, facilitating the folding of the heating device body 1.

Referring to FIG. 6, in one embodiment, the divider 120 may be detachably connected to the heating device body 1. Specifically, as mentioned above, end portions of the divider 120 connected to the heating device body 1 may be detachably connected to corresponding inner walls of the heating device body 1 by means such as a hook-and-loop fastener or a snap fastener. Thus, when the towel heating device needs to be stored, the divider 120 may first be removed or partially removed from the heating device body 1, and connections between the bottom wall 15 and one of the two body walls 13 as well as the two folding walls 14 may be released. The bottom wall 15 may then be folded toward the top portion of the towel heating device until the bottom wall 15 lies flat against the other of the two body walls 13 which is still connected with the bottom wall 15.

In one embodiment, the second divider sheet 1202 may be movably connected to the first divider sheet 1201, allowing the second divider sheet 1202 to be foldable relative to the first divider sheet 1201. Thus, when the towel heating device needs to be stored and after the divider 120 is removed or partially removed from the heating device body 1, the second divider sheet 1202 may be folded against the first divider sheet 1201. The divider 120 may then be placed flat between the two body walls 13, or stacked against an outer wall of the heating device body 1.

Figure 5:
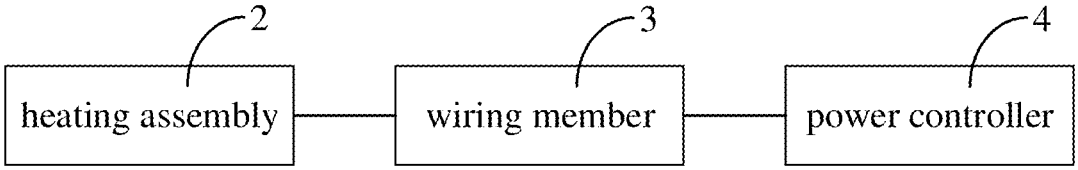
FIG. 5 is a schematic block view of a heating assembly, a wiring member, and a power controller according to an embodiment of the present disclosure.

In one embodiment of the present disclosure, as shown in FIG. 5, the towel heating device may further include a wiring member 3. The wiring member may be arranged on the heating device body 1. The wiring member 3 may include an input end and an output end. The output end may be electrically connected to the heating assembly 2, and the input end may be suitable for electrical connection to an external power controller 4 to supply power to the heating assembly 2 and control an operation of the heating assembly 2.

In one embodiment of the present disclosure, as shown in FIGS. 1 and 4, the heating device body 1 may further include a handle 130. Particularly, two handles 130 may be provided. Each of the two handles 130 may be mounted on a respective one of the two folding walls 14, making it convenient for users to carry.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Unless indicated otherwise, not all steps listed in the various figures need be carried out in the specific order described.

What is claimed is:

1. A towel heating device, comprising:

a heating device body, defining an accommodation cavity and an opening communicated with the accommodation cavity and comprising:

two body walls;

two folding walls arranged opposite each other, wherein each of the two folding walls defines a folding groove, each of the two folding walls is configured to fold or unfold along the folding groove of a respective one of the two folding walls and drive the two body walls to move close to or away from each other; and a heating assembly, at least partially arranged on at least one of the two body walls and the two folding walls and configured to heat the accommodation cavity;

wherein, each wall of the two body walls and the two folding walls comprises a first flexible layer, a reinforcement plate, a thermal insulation layer, and a second flexible layer, which are arranged in sequence.

2. The towel heating device according to claim 1, wherein each of the two folding walls comprises a first connecting wall and a second connecting wall, the first connecting wall is movably connected to one of the two body walls, the second connecting wall is movably connected to the other of the two body walls, and the folding groove of each of the two folding walls is vertically formed between the first connecting wall of a respective one of the two folding walls and the second connecting wall of the respective one of the two folding walls.

3. The towel heating device according to claim 1, wherein the heating device body further comprises a bottom wall, each of the two body walls and the two folding walls is connected to the bottom wall, and the bottom wall, the two body walls, and the two folding walls cooperatively define the accommodation cavity.

4. The towel heating device according to claim 3, wherein the bottom wall is movably connected to one of the two body walls and is foldable relative to the one of the two body walls, and each of the other of the two body walls and the two folding walls is detachably connected to the bottom wall.

5. A towel heating device, comprising:

a heating device body, defining an accommodation cavity and an opening communicated with the accommodation cavity and comprising:

two body walls;

two folding walls arranged opposite each other, wherein each of the two folding walls defines a folding groove, each of the two folding walls is configured to fold or unfold along the folding groove of a respective one of the two folding walls and drive the two body walls to move close to or away from each other; and a heating assembly, at least partially arranged on at least one of the two body walls and the two folding walls and configured to heat the accommodation cavity;

wherein:

the heating device body further comprises a bottom wall, each of the two body walls and the two folding walls is connected to the bottom wall, and the bottom wall, the two body walls, and the two folding walls cooperatively define the accommodation cavity; and the bottom wall comprises a first flexible layer, a rigid layer, and a second flexible layer which are arranged from an exterior of the towel heating device to an interior of the towel heating device;

a side of each of the first flexible layer and the second flexible layer is movably connected to one of the two body walls, and other sides of each of the first flexible layer and the second flexible layer is detachably connected to each of the two folding walls and the other of the two body walls.

6. The towel heating device according to claim 3, wherein the heating assembly is partially arranged on the bottom wall.

7. The towel heating device according to claim 3, wherein a bottom face of the bottom wall is arranged with a plurality of support feet.

8. The towel heating device according to claim 3, further comprising a shielding layer, the shielding layer is flexible and is arranged on a side of the bottom wall away from the accommodation cavity.

9. The towel heating device according to claim 2, wherein, each of the first flexible layer and the second flexible layer is a fabric layer.

10. The towel heating device according to claim 9, wherein the first connecting wall of the each of the two folding walls and one of the two body walls are flexibly connected to each other through at least one of the first fabric layer and the second fabric layer;

the second connecting wall of the each of the two folding walls and the other of the two body walls are flexibly connected to each other through at least one of the first fabric layer and the second fabric layer;

the first connecting wall of the each of the two folding walls and the second connecting wall of a respective one of the two folding walls are flexibly connected to each other through at least one of the first fabric layer and the second fabric layer to form the folding groove of the respective one of the two folding walls.

11. The towel heating device according to claim 9, wherein the heating assembly is arranged in the thermal insulation layer, and the heating assembly is configured as a heating wire.

12. The towel heating device according to claim 1, further comprising a cover, wherein the cover comprises a body portion and an extension portion; the body portion detachably covers the opening of the accommodation cavity, and the body portion comprises a connecting end and an extending end; the connecting end is movably connected to the heating device body, the extension portion is arranged at the extending end, and the extension portion is detachably connected to the heating device body.

13. The towel heating device according to claim 12, wherein the cover at least comprises a first fabric layer, a reinforcement plate, and a second fabric layer, and the body portion is flexibly connected to the heating device body through at least one of the first fabric layer and the second fabric layer.

14. The towel heating device according to claim 1, wherein the heating device body further comprises a divider which is flexible, the divider is arranged in the accommodation cavity and is configured to partition the accommodation cavity to a plurality of storage spaces, the divider is detachably connected to the heating device body, and when each of the two folding walls is folded, the divider is detachably attached to an inner wall of the heating device body.

15. The towel heating device according to claim 14, wherein the divider comprises a first divider sheet and at least one second divider sheet, the first divider sheet extends across the accommodation cavity in a length direction of the accommodation cavity, the at least one second divider sheet extends across the accommodation cavity in a width direction of the accommodation cavity, and the first divider sheet and the at least one second divider sheet cooperatively partition the accommodation cavity to the plurality of storage spaces;

the at least one second divider sheet is connected between the first divider sheet and either of the two body walls.

16. The towel heating device according to claim 14, wherein the at least one second divider sheet is movably connected to the first divider sheet and is foldable relative to the first divider sheet.

17. The towel heating device according to claim 1, further comprising a wiring member, wherein the wiring member is arranged on the heating device body, the wiring member comprises an input end and an output end, the output end is electrically connected to the heating assembly, and the input end is configured to be electrically connected to an external power controller.

18. The towel heating device according to claim 1, wherein the heating device body further comprises a handle mounted on at least one of the two folding walls.

* * * * *